US009643398B1

(12) United States Patent
Knausdorf et al.

(10) Patent No.: US 9,643,398 B1
(45) Date of Patent: May 9, 2017

(54) VARIABLE DATA AND DIRECT MARKING OF PRINT MEDIA WITH HIGH VISCOSITY MATERIALS

(71) Applicant: XEROX CORPORATION, Norwalk, CT (US)

(72) Inventors: Peter J. Knausdorf, Henrietta, NY (US); Jack T. Lestrange, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/967,134

(22) Filed: Dec. 11, 2015

(51) Int. Cl.
*B41F 7/24* (2006.01)

(52) U.S. Cl.
CPC ..... *B41F 7/24* (2013.01)

(58) Field of Classification Search
CPC ..... G03F 7/2004; G03F 7/20; G03F 7/2006; B41F 7/02; B41F 7/025; B41F 7/04; B41F 7/30; B41F 7/32; B41F 7/40
See application file for complete search history.

(56) References Cited

U.S. PATENT DOCUMENTS 3,800,699 A * 4/1974 Carley ..... B41C 1/06 101/147
4,718,340 A * 1/1988 Love, III ..... B41C 1/055 101/116
7,100,503 B2 * 9/2006 Wiedemer ..... B41C 1/1075 101/451
9,021,948 B2 * 5/2015 Pattekar ..... G03G 15/10 101/148
2012/0103212 A1 * 5/2012 Stowe ..... B41C 1/1041 101/147
2013/0033687 A1 * 2/2013 Stowe ..... B41F 7/30 355/30
2013/0247788 A1 * 9/2013 Liu ..... B41F 7/32 101/147
2014/0060365 A1 * 3/2014 Gervasi ..... C09D 127/16 101/451

* cited by examiner

*Primary Examiner* — David Banh
(74) *Attorney, Agent, or Firm* — Prass LLP; Ellis B. Ramirez

(57) ABSTRACT

An improved apparatus and method for printing directly onto Infra-Red (IR) transparent material (print media) such as Mylar using a method that is capable of using medium to high viscosity materials such as those needed for printed electronics. The proposed method would be able to print with variable data/imaging. A proposed method uses an IR receptor of which a print media is placed or passed over. Prior to irradiation the print media is coated with a sub-micron layer of dampening solution such as silicone oil that is then selectively evaporated off via a laser imaging device which passes IR energy thorough the dampening solution, print media and onto the receptor to evaporate dampening solution in areas that will be inked.

26 Claims, 6 Drawing Sheets

VARIABLE DATA AND DIRECT MARKING OF PRINT MEDIA WITH HIGH VISCOSITY MATERIALS

BACKGROUND OF THE INVENTION

The disclosure relates to ink-based digital printing. In particular, the disclosure relates to printing variable data directly on a print substrate using an ink-based digital printing system that includes dampening fluid and ink that only adheres to evaporated areas on the print substrate.

Conventional lithographic printing techniques cannot accommodate true high-speed variable data printing processes in which high viscosity materials is being printed onto substrates with variable data in production.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process. In variable data lithography an image is transferred to a substrate by pressing an image plate onto a substrate. However, in such a system or process is difficult to print high viscosity materials such as those needed for printed electronics.

The problem of printing high viscosity inks or materials using variable data is a current problem for current marking systems. Current systems such as offset lithography and inkjet marking, but not limited to those, can either print high viscosity or variable data but not both. In conventional offset printing, the printing process may include transferring radiation-curable ink onto a portion of an imaging member surface (plate, drum, or the like) that has been selectively coated with a dampening fluid layer according to variable image data. The ink is then transferred from the printing plate to a substrate such as paper, plastic, or metal on which an image is being printed and subsequently cured. However, while conventional offset printing can print medium to high viscosity inks it cannot print variable data. Inkjet marking systems can print variable data but not using medium or high viscosity inks.

As such, there is a need to overcome the deficiencies of conventional printing technology for printing variable data with high viscosity inks or materials. There is also a need in the art for a printing process that can print high viscosity inks directly to the print substrate with variable image data.

BRIEF SUMMARY OF THE INVENTION

Accordingly, an improved apparatus and method for printing directly onto Infra-Red (IR) transparent material (print media) such as Mylar using a method that is capable of using medium to high viscosity materials such as those needed for printed electronics. The proposed method would be able to print with variable data/imaging. The proposed method uses an IR receptor of which a print media is placed or passed over. Prior to irradiation the print media is coated with a sub-micron layer of dampening solution such as silicone oil that is then selectively evaporated off via a laser imaging device which passes IR energy thorough the dampening solution, print media and onto the receptor to evaporate dampening solution in areas that will be inked.

DETAILED DESCRIPTION OF THE INVENTION

Figure 1:
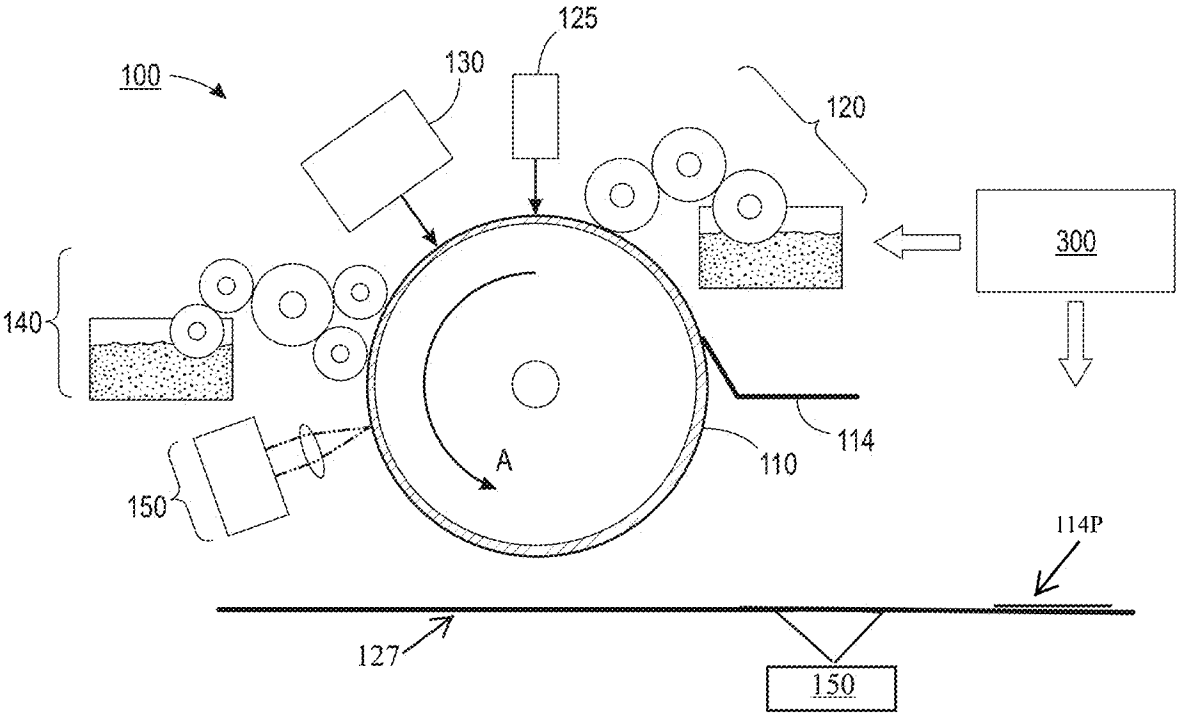
FIG. 1 is a side view of one apparatus for printing directly onto a print media and used in conjunction with embodiments herein.

Illustrative examples of the devices, systems, and methods disclosed herein are provided below. An embodiment of the devices, systems, and methods may include any one or more, and any combination of, the examples described below.

Example 1 includes an apparatus for printing directly onto a print substrate in a variable data lithography system, comprising: a dampening fluid reservoir configured to provide dampening fluid in an airborne state or by direct contact to said print substrate; a photoreceptor having a first surface which receives incident electromagnetic radiation, wherein said photoreceptor generates heat at the point of incident electromagnetic radiation; wherein the heat generated by the photoreceptor causes dampening fluid patterning on the print substrate.

Example 2 includes the subject matter of example 1, further comprising: an inking system for applying ink to the print substrate having patterned dampening fluid disposed thereon.

Example 3 includes the subject matter of example 2, wherein the photoreceptor is a drum or a plate.

Example 4 includes the subject matter of example 3, wherein the print substrate is transparent to the incident electromagnetic radiation.

Example 5 includes the subject matter of example 4, wherein dampening fluid patterning is removing, at the print substrate, a portion of the dampening solution through evaporation.

Example 6 includes the subject matter of example 5, wherein the dampening fluid patterning forms a latent image on the print substrate and the latent image is then developed by an application of ink or other material that only adheres to evaporated areas on the print substrate.

Example 7 includes the subject matter of example 2, wherein the photoreceptor is the print substrate itself.

Example 8 includes the subject matter of example 2, wherein the print substrate comprises two layers where one layer is transparent to the incident electromagnetic radiation and the second layer is absorbent of the incident electromagnetic radiation.

Example 9 includes the subject matter of example 2, wherein the print substrate comprises three layers and wherein a layer that is absorbent of the incident electromagnetic radiation is sealed with a nonconductive transparent film.

Example 10 includes method for printing directly onto a print substrate in a variable data lithography system, comprising providing dampening fluid in an airborne state or by direct contact to said print substrate from a dampening fluid reservoir; using a photoreceptor having a first surface which receives incident electromagnetic radiation, wherein said photoreceptor generates heat at the point of incident electromagnetic radiation; wherein the heat generated by the photoreceptor causes dampening fluid patterning on the print substrate.

Example 11 includes at least one machine readable medium comprising a plurality of instructions that in response to being executed on a computing device, cause the computing device to carry out a method according to example 10.

Example 12 includes system useful in printing, comprising: a print substrate comprising Infra-Red (IR) transparent material for carrying high viscosity inks and/or dampening fluid; a dampening fluid reservoir configured to provide the dampening fluid to said print substrate; a photoreceptor having a first surface which receives IR energy, wherein said photoreceptor generates heat at the point of incident of the IR energy and wherein the heat generated by the photoreceptor causes dampening fluid patterning on the print substrate; an inking unit for applying a high viscosity ink to the print substrate having patterned dampening fluid disposed thereon; a processor; and a storage device coupled to the processor, wherein the storage device contains instructions operative on the processor for: causing an IR source to apply the IR energy to the print substrate and the photoreceptor to form a first process direction image on the print substrate; applying the high viscosity ink on the print substrate; and repeating application of the IR energy and high viscosity ink on areas of the print substrate with remaining dampening fluid to form one or more additional image when it is determined that an additional image can be patterned on the print substrate.

Although embodiments of the invention are not limited in this regard, discussions utilizing terms such as, for example, "processing", "computing", "calculating", "determining", "applying", "receiving", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "controller" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "print media", "print substrate" and "print sheet" generally refers to a usually flexible, sometimes curled, physical sheet of paper, Mylar material, plastic, or other suitable physical print media substrate for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" can handle sheets, webs, marking materials, and the like. A printing system can place marks on any surface, and the like and is any machine that reads marks on input sheets; or any combination of such machines.

As used herein, an "electromagnetic receptor" or "electromagnetic absorbent" is a material which will interact with an electromagnetic field to dissipate energy such as heat. The energy delivered by the applied electromagnetic field could be used to trigger thermal losses at the receptor through a combination of loss mechanisms. Examples of electromagnetic receptors include any conductive metal. As used herein, an "electromagnetic transparent" material is made of a substance that is substantially transparent to the applied electromagnetic radiation of interest and does not degrade in the operating environment. Examples of transparent material include clear plastics like packaging tapes, ultra-thin glass, Mylar by DuPont, Arylite, Appear, and Sumlite from Promerus of Brecksville Ohio.

For illustrative purposes, although the term "fixing apparatus" is used herein throughout the application, it is intended that the term "fixing apparatus" also encompasses members useful for a printing process or in a printing system including, but not limited to, a fixing member, a pressure member, UV curing member, an Electron Beam curing member, a heat member, and/or a donor member. In various embodiments, the fixing apparatus can be in a form of, for example, a roller, a cylinder, a belt, a plate, a film, a sheet, a drum, a drelt (cross between a belt and a drum), or other known form for a fixing apparatus. A "fixing apparatus", as described and claimed herein, may be adapted to be useful in other types of printing, such as solid-inkjet printing, iconography, xerography, flexography, offset printing, and the like.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

As shown in FIG. 1, the exemplary system 100 may include an electromagnetic receptor 110. The electromagnetic receptor 110 in the embodiment shown in FIG. 1 is a drum, but this exemplary depiction should not be interpreted so as to exclude embodiments wherein the electromagnetic receptor 110 includes a drum, plate or a belt, or another now known or later developed configuration. The electromagnetic receptor 110 is used to apply heat to the print substrate 114, the heat resulting from heat generated at the point of incident electromagnetic radiation from a source operating at a predetermined band of electromagnetic wavelengths.

A Controller 300 is shown and it is capable of receiving information and instructions from a workstation and from image input devices to coordinate the image formation on the print substrate through the various subsystems such as the dampening fluid system 120, the patterning subsystem 130, the inker subsystem 140, and the like.

Print substrate 114 should not be considered to be limited to any particular composition such as, for example, paper, plastic, or composite sheet film. The exemplary system 100 may be used for producing images on a wide variety of image receiving print or media substrates. The exemplary system 100 includes a dampening fluid system 120 that delivers a layer of dampening solution, generally having a uniform and controlled thickness, to form a reimageable surface on the print substrate 114. The dampening solution may be applied via direct contact or in an airborne state such as by steam, atomized fluid, nebulized fluid, or otherwise made to be in particulate form and airborne for the purpose of transporting same by way of a gas flow. The dampening solution is non-aqueous consisting of, for example, silicone fluids (such as D3, D4, D5, OS10, OS20 and the like), and polyfluorinated ether or fluorinated silicone fluid.

The dampening solution can also be a water or aqueous-based fountain solution which is generally applied by direct contact with the print substrate 114 through a series of rollers for uniformly wetting the print substrate with the dampening fluid. As indicated above, a dampening solution or a dampening fluid may comprise mainly water that is optionally combined with small amounts of isopropyl alcohol or ethanol to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water and mixtures of the Novec™ solvents.

Once the dampening fluid is metered onto the print substrate 114, a thickness of the dampening fluid may be measured using a sensor 125 that may provide feedback to control (controller 300) the metering of the dampening fluid onto the surface of the print substrate 114 by the dampening fluid system 120.

After a precise and uniform amount of dampening fluid is provided by the dampening fluid system 120 on the print substrate 114, and optical patterning subsystem 130 may be used to selectively form a latent image in the uniform dampening fluid layer by image-wise patterning the dampening fluid layer using, for example, laser energy or optical energy in the infrared (IR) wavelengths of the electromagnetic spectrum. Typically, the dampening solution will not absorb the optical energy (IR or visible) efficiently. In this embodiment, the print substrate and the dampening solution are transparent to an electromagnetic source operating within a range of wavelengths such as in the range emitted by infrared (IR) sources. In other embodiments, such as described below, the print substrate is combined with a receptor or has material that is absorbent of the incident electromagnetic radiation so as to generate its heat for image patterning.

The surface of the electromagnetic receptor 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy at the print media 114. While the optical patterning subsystem 130 is described above as being a laser emitter, it should be understood that a variety of different systems may be used to deliver the optical energy to pattern the dampening fluid on the print substrate.

The mechanics at work in the patterning process undertaken by the optical patterning subsystem 130 results in selective removal of portions of the layer of dampening fluid on the print substrate as a result of the heat generated in the upper surface of the electromagnetic receptor 110. Following patterning of the dampening fluid layer by the optical patterning subsystem 130, the patterned layer over the print substrate 114 as created by the heat of the of the electromagnetic receptor 110 is transferred to an inker subsystem 140. The inker subsystem 140 is used to apply a uniform layer of ink over the layer of dampening fluid and the reimageable surface layer of the print substrate 114. The inker subsystem 140 may use an anilox roller to meter an offset lithographic ink onto one or more ink forming rollers that are in contact with the reimageable surface layer of the print substrate 114. Separately, the inker subsystem 140 may include other traditional elements such as a series of metering rollers to provide a precise feed rate of ink to the print substrate. The inker subsystem 140 may deposit the ink to the pockets representing the imaged portions of the print substrate, while ink on the unformatted portions of the dampening fluid will not adhere to those portions.

After inking, the inked/print substrate is moved to a fixing station such as fixing mechanisms 150 that may include optical or photo curing, heat curing, drying, or various forms of chemical curing.

After processing at the fixing apparatus and/or inking the print substrate 114, there may be residual ink or fountain solution that went beyond the edges of the substrate causing it to be transferred to the electromagnetic receptor 110. Such debris may be removed using known cleaning methods and solutions. For example, an air knife may be employed to remove residual dampening fluid.

Following the inking and optional cohesiveness modification, the print substrate is fed to transport handling mechanism 127 such as a belt or gripper apparatus that serves to deliver single sheets, part of a roll of paper, or bundles of sheets after inking to a finishing station or to another fixing apparatus like fixing system 150. The fixing apparatus executes a fixing process. The fixing process can be through the application of heat and air. An exemplary fixing apparatus uses IR radiation to cure ultra violet (UV) inks and the like. Another exemplary fixing apparatus, especially suitable when using solvent inks and the like, employs air on the inked imaged on the print substrate 114, shown as 114P, to indicate a substrate that has been imaged and inked.

Next, a second embodiment of the present invention will be described. Note that portions which are the same as those in the first embodiment described above are denoted by the same reference numerals, and descriptions of the same portions as those as in the first embodiment will be omitted.

Figure 2:
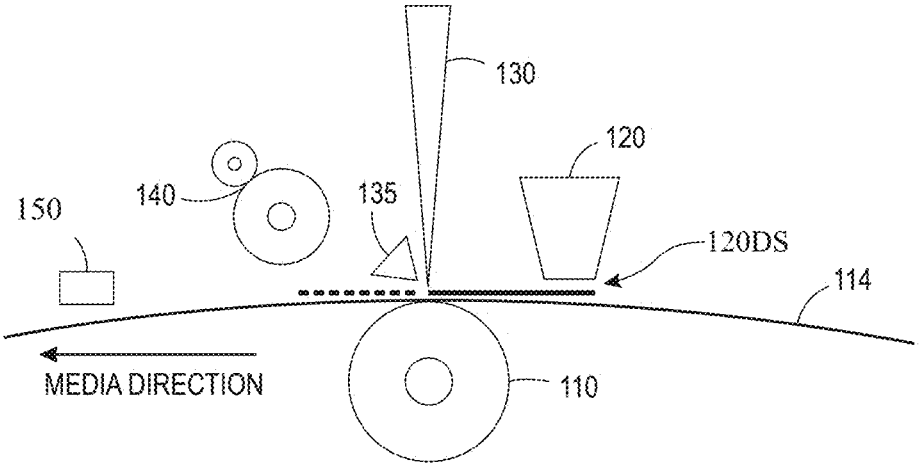
FIG. 2 is a perspective view of an apparatus similar to that shown in FIG. 1 for printing directly onto a print media.

FIG. 2 is a perspective view of an apparatus similar to that shown in FIG. 1 for printing directly onto a print media.

Referring to FIG. 2, an IR transparent print media 114 is transported from right to left in a continuous manner without stopping (media direction). As the print media 114 moves it is coated with a dampening solution 120DS, such as D4 or any fluid that resists combining with the ink or material being applied. In this illustration, the dampener is a system 120 that creates a vapor that condenses on the media. The media coated with dampening solution 120DS continues past the beam of an IR laser 130 that is modulated on and off. The absorption of the IR energy into the IR receptor such as electromagnetic receptor 110 causes the dampening agent to evaporate away only at the point spot of the laser. The laser is modulated in a line that is perpendicular to the process direction (media direction). The line of laser light can be turned on and off in segments or points of light which form the resolution of the process. As the media continues to move past the laser modulated line, dampening solution is evaporated in the process direction, forming the process direction image. Evaporated fountain solution is collected at a point immediately after evaporation 135 so as to prevent recondensing of the solution. After vapor collection 135 the imaged print media/fountain solution is inked with a roller containing ink or other printing material that only adheres to areas where the dampening solution has been evaporated away from as described with reference inker subsystem 140. The print media with inked or wet image is then fixed/cured such as by Fixing system 150 with the appropriate drying or curing method appropriate for the material being applied which completes the process. In the case of ultraviolet (UV) inks this would be a UV light source such as rheology control subsystem 150.

Figure 3:
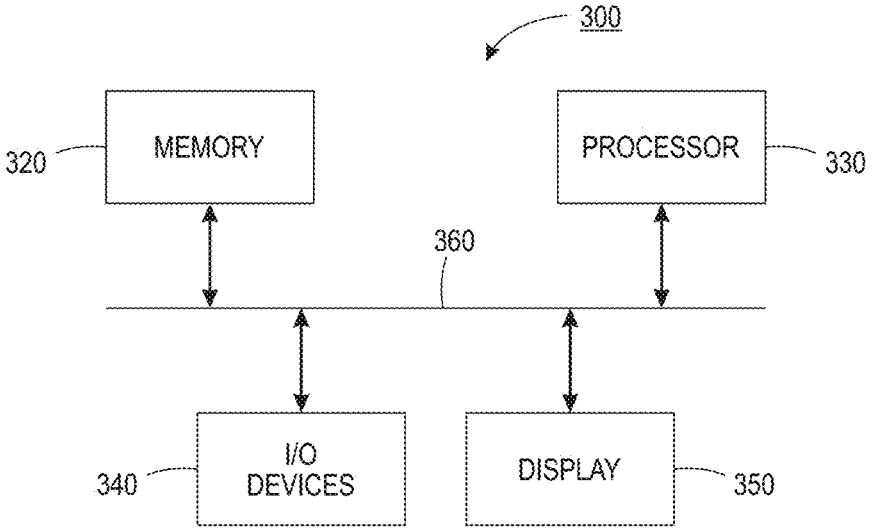
FIG. 3 illustrates a block diagram of a controller with a processor for executing instructions to automatically control devices in the apparatus illustrated in FIG. 1 or FIG. 2 in accordance to an embodiment.

FIG. 3 illustrates a block diagram of a controller 300 with a processor for executing instructions to automatically control devices in the apparatus illustrated in FIG. 1 in accordance to an embodiment.

The controller 300 may be embodied within devices such as a desktop computer, a laptop computer, a handheld computer, an embedded processor, a handheld communication device, or another type of computing device, or the like. The controller 300 may include a memory 320, a processor 330, input/output devices 340, a display 330 and a bus 360. The bus 360 may permit communication and transfer of signals among the components of the controller 300 or computing device.

Processor 330 may include at least one conventional processor or microprocessor that interprets and executes instructions. The processor 330 may be a general purpose processor or a special purpose integrated circuit, such as an ASIC, and may include more than one processor section. Additionally, the controller 300 may include a plurality of processors 330.

Memory 320 may be a random access memory (RAM) or another type of dynamic storage device that stores information and instructions for execution by processor 330. Memory 320 may also include a read-only memory (ROM) which may include a conventional ROM device or another type of static storage device that stores static information and instructions for processor 330. The memory 320 may be any memory device that stores data for use by controller 300.

Input/output devices 340 (I/O devices) may include one or more conventional input mechanisms that permit data between component of apparatus 10 and for a user to input information to the controller 300, such as a microphone, touchpad, keypad, keyboard, mouse, pen, stylus, voice recognition device, buttons, and the like, and output mechanisms for generating commands, voltages to power actuators, motors, and the like or information to a user such as one or more conventional mechanisms that output information to the user, including a display, one or more speakers, a storage medium, such as a memory, magnetic or optical disk, disk drive, a printer device, and the like, and/or interfaces for the above. The display 330 may typically be an LCD or CRT display as used on many conventional computing devices, or any other type of display device.

The controller 300 may perform functions in response to processor 330 by executing sequences of instructions or instruction sets contained in a computer-readable medium with readable program code, such as, for example, memory 320. Such instructions may be read into memory 320 from another computer-readable medium, such as a storage device, or from a separate device via a communication interface, or may be downloaded from an external source such as the Internet. The controller 300 may be a stand-alone controller, such as a personal computer, or may be connected to a network such as an intranet, the Internet, and the like. Other elements may be included with the controller 300 as needed.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages like Perl or Python. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The memory 320 may store instructions that may be executed by the processor to perform various functions. For example, the memory may store instructions to deposit the marking material using at least one ink jet print head on at least one of the cup-shaped mesas. Maneuver or change the height distance between the ink jet print head and the mesa surface. Instructions so as to use a heating source to increase a jetted marking material viscosity before the imaging member contacts the marking material on the print substrate in a print process; instructions to control the print heads, motion of the drum, and to convert the electronic image signals 220 into control commands for the print heads and movement of the drum; and, control instructions to press the imaging member against the print substrate to form an array of marking material mesas thereon.

Figure 4A:
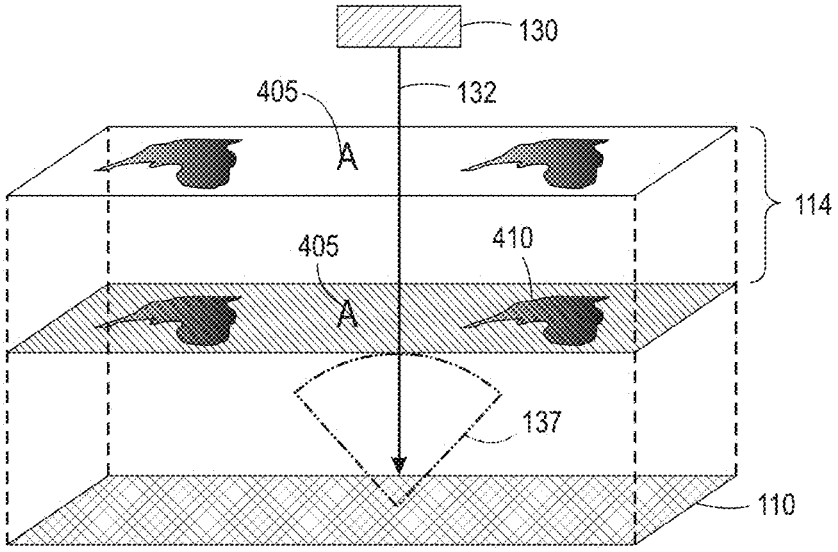
FIG. 4A illustrates how an incident electromagnetic source is used to cause dampening fluid patterning on a print media from the heat generated by a receptor in accordance to an embodiment.

FIG. 4A illustrates how an incident electromagnetic source is used to cause dampening solution patterning on a print media from the heat generated by a receptor in accordance to an embodiment. FIG. 4A illustrates a mechanism by which an image can be formed by a direct application of fountain solution (410) onto IR transparent media (print media 114) then followed by incident electromagnetic (EM) radiation (132) from an electromagnetic source (130) generating a pattern (405) such as an image on print media 114. As shown the EM wave passes through the dampened media but is absorbed by a receptor (110) such as a drum or a plate causing it to generate patterning producing heat. The transferred heat energy 137 causes selective evaporation of the dampening solution at the print media so as to form part of a latent image 405. The latent image 405 is then developed by an application of ink or other material that only adheres to the evaporated areas or that is devoid of the applied solution.

Figure 4B:
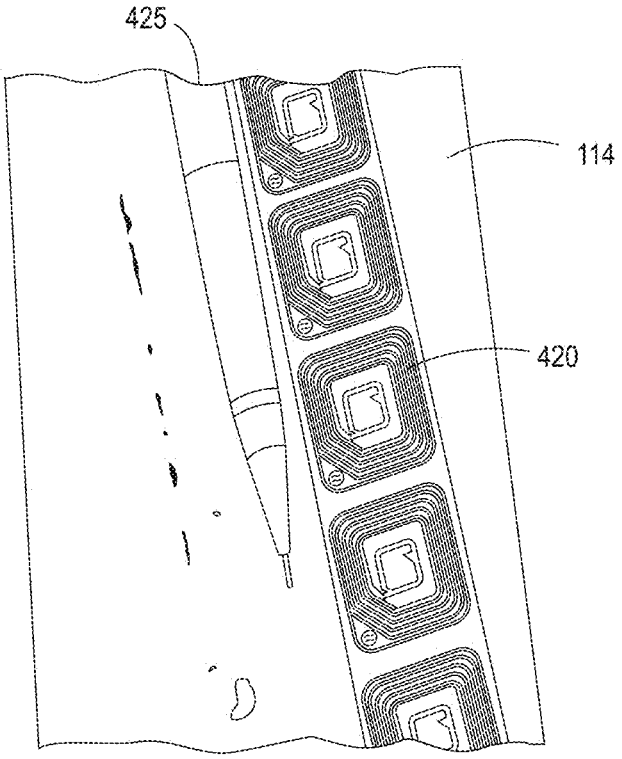
FIG. 4B shows a direct onto tape Radio Frequency Identification Device (RFID) printed on a print media using the apparatus of FIG. 1 or FIG. 2 in accordance to an embodiment.

FIG. 4B shows a direct onto tape Radio Frequency Identification Device (RFID) printed on a print media using the apparatus of FIG. 1 or FIG. 2 in accordance to an embodiment. FIG. 4B shows a print media 114 such as packaging tape with printed RFID tags 420 using the apparatus described in FIG. 1 or FIG. 2. The RFID tags 420 where printed directly onto the packaging tape without the need to use an intermediate transfer process. A mechanical pencil 425 is drawn next to the RFID tags to illustrate the relative dimensions of the tags. Being that this is a direct to print substrate process there is no cleaner needed since all rejected ink by the dampening solution stays on the inking roll.

Figure 5A:
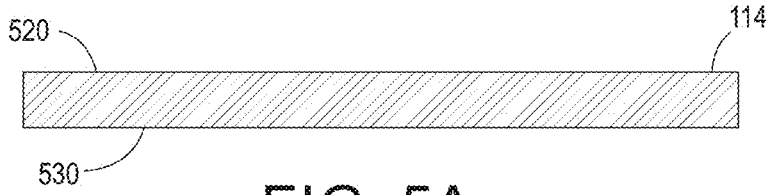
FIG. 5A illustrates a print media made of electromagnetic absorbent material where the heat energy is absorbed by the print media itself to cause dampening fluid patterning on the surface of the print media in accordance to an embodiment.

FIG. 5A illustrates a print media made of electromagnetic absorbent material where the heat energy is absorbed by the print media itself to cause dampening fluid patterning on the surface of the print media in accordance to an embodiment. In the illustrated embodiment, the print media 114 uses an electromagnetic absorbent material, i.e., the receptor 530 is the media itself, to generate the heat energy needed to form an image. This would provide higher resolution imaging on the imaged surface 520 as there would be no diffusion of energy through the print media, but might preclude some applications such as printed electronics where an electromagnetic absorbent such as carbon black or iron oxide would be conductive and short out any printed traces or wires.

Figure 5B:
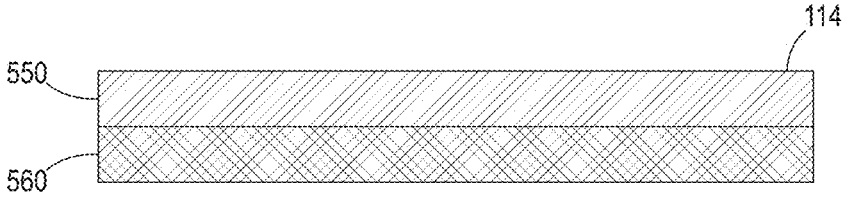
FIG. 5B illustrates a two layer print media, one layer is electromagnetic transparent, and the second layer is electromagnetic absorbent in accordance to an embodiment.

FIG. 5B illustrates a two layer print media, one layer is electromagnetic transparent, and the second layer is electromagnetic absorbent in accordance to an embodiment. In this embodiment, the print media 114 would be a two layer media, one layer IR transparent 550, and the second layer IR absorbent 560. The print media is dampened and imaged through the clear side which is the followed by ink on the same clear side. This would allow for the use of conductive ink in the formation of printed circuits and no IR receptor drum would be needed such as a photo receptor or photoreceptor (110) to generate the heat.

Figure 5C:
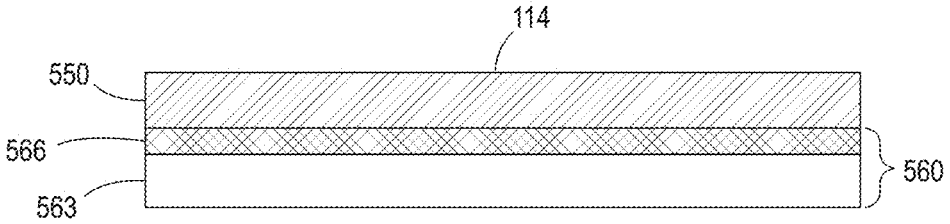
FIG. 5C illustrates a three layered media with a base coated with an electromagnetic absorbent material that is sealed by a transparent film in accordance to an embodiment.

FIG. 5C illustrates a three layered media with a base coated with an electromagnetic absorbent material that is sealed by a transparent film in accordance to an embodiment. In this embodiment, which is similar to the embodiment described in FIG. 5B, the IR absorbent layer 560 is sub-divided into distinct layers. A three layered media such as a Mylar base coated with an IR absorbent 563 such as carbon black or iron oxide, with the IR absorbent layer 563 then being sealed with a nonconductive IR transparent film having a top surface 550 and a lower surface 563. This embodiment and the embodiment of FIG. 5B would have the advantage of being able to be used for printed electronics whereby the IR absorbent layer 563 also formed a ground plane which is often useful in circuit boards for the purpose of noise immunity.

Figure 5D:
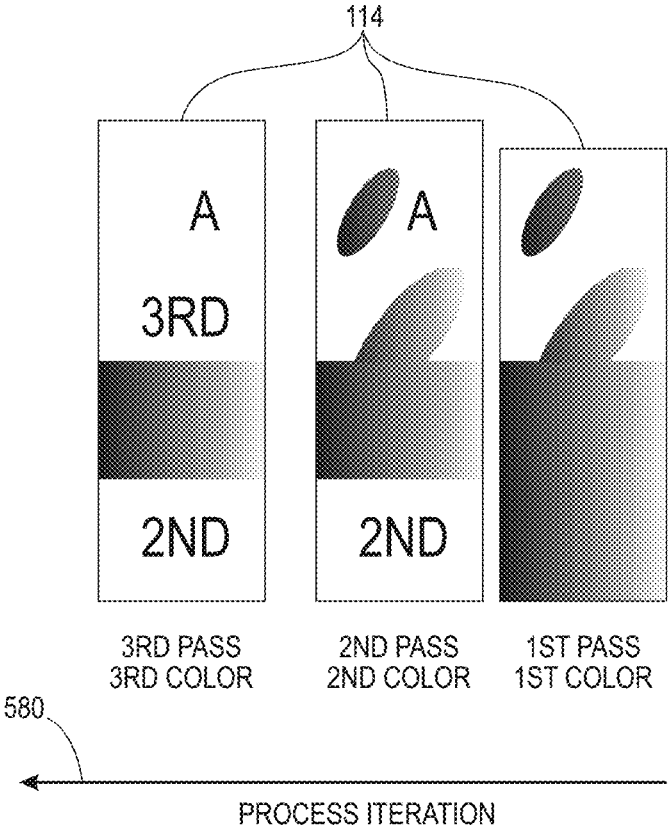
FIG. 5D illustrates a multi-pass process where imaging is performed in areas void of any ink in accordance to an embodiment; and, FIG. 6 is a flowchart of a process for printing directly onto a print media in accordance to an embodiment.

FIG. 5D illustrates a multi-pass process where imaging is performed in areas void of any ink in accordance to an embodiment. The illustrated embodiment is to print color next to color on the print media 114. In this approaches, the print process (process iteration 580) is discretized to accommodate a particular image and a particular ink color. This embodiment includes any of the prior embodiments, but inks subsequent images after the first image is inked or fixed, in those areas void of any ink. This technique would be applicable to "N" number of colors, the only requirement being that the IR receptor material is not covered with ink.

Figure 6:
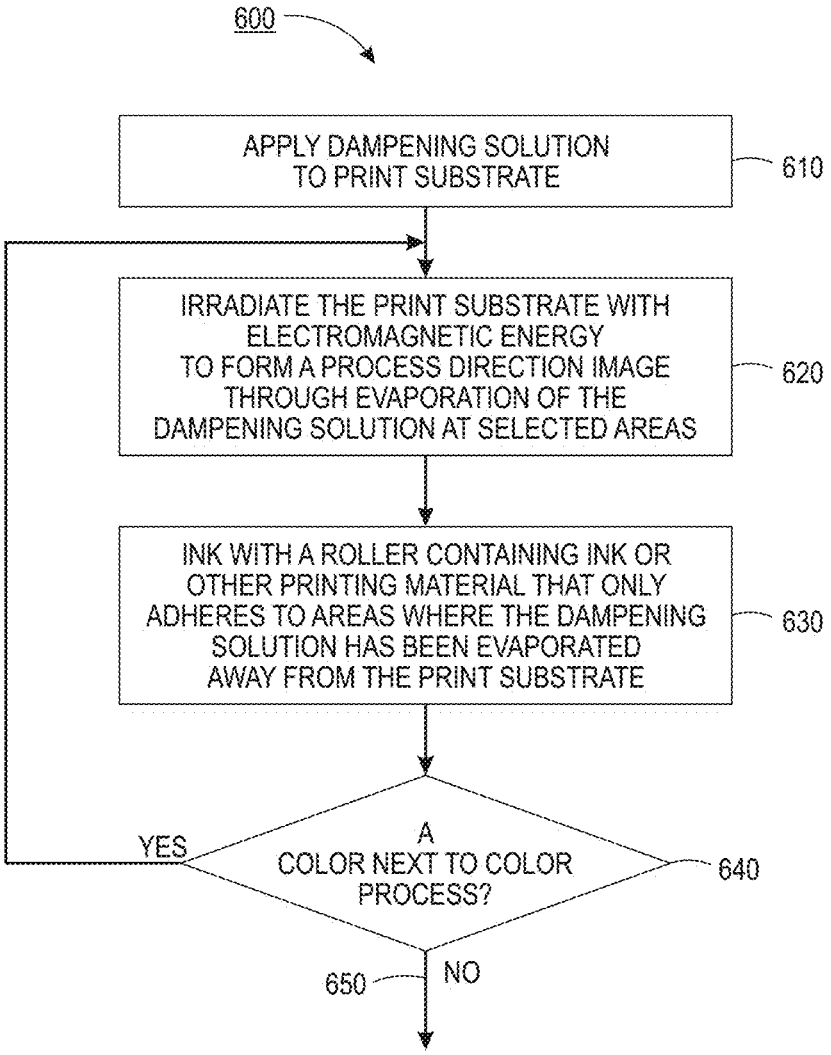

FIG. 6 is a flowchart of a process for printing directly onto a print media in accordance to an embodiment. The process 600 begins with action 610 by applying dampening solution to a print substrate like print media 114. In action 620, the process 600 then irradiates the print substrate electromagnetic energy to forma process direction image through evaporation of the dampening solution at selected areas of the print substrate like print media 114. In action 630, the process 600 inks with a roller containing ink or other printing material that only adheres to areas where dampening solution has been evaporated away from the print substrate. In action 640 a determination is made to determine if the current process is color next to color process. When it is determined that a color next to color process is being executed then repeating actions 620 and 630 for the desired number of colors like shown in FIG. 5D. If the determination at action 640 is that the process id one of, i.e., a single color or one process iteration, then forwarding or invoking a termination process 650. The described process (600) directly images and inks the print media 114 resulting in less waste of ink and without the need for cleaners to prepare for the next image.

Embodiments of the present disclosure address the deficiencies of conventional printing technology when using variable data with high viscosity inks or materials. Embodiments have been disclosed that propose printing directly onto Infra-Red (IR) transparent material such as Mylar using a method that is capable of using medium to high viscosity materials such as those needed for printed electronics. The proposed method is able to print with variable data/imaging. The proposed method uses a seamless IR receptor like an IR absorbing drum of which an IR transparent print media is passed over. Prior to passing over the drum the print media is coated with a sub-micron layer of dampening solution such as D4 silicone oil. The dampening solution is then selectively evaporated off via a laser imaging device which passes IR energy thorough the dampening solution, print media and onto the IR receptor drum as the media travels over the drum, evaporating dampening solution in areas that will be inked. The imaged print media is then passed under an ink/material roller whereby ink or other viscous material is applied only to the areas without dampening solution due to the ink being rejected by the dampening solution. Some benefits of the method include reduced ink waste (a big cost savings for printed electronics), use of higher viscosity ink, and support of digital variable content. Since the method employs a direct to substrate process, there is no cleaner needed as all rejected ink stays on the inking roll.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus for printing comprising:

a print substrate;

a dampening fluid system having a dampening fluid reservoir configured to provide dampening fluid in an airborne state or via direct contact on said print substrate;

wherein the dampening fluid system delivers a layer of dampening solution to form a reimageable surface on said print substrate;

optical patterning subsystem that emits infrared (IR) electromagnetic radiation in a direction towards the print substrate;

a photoreceptor having a first surface which receives incident electromagnetic radiation, wherein said photoreceptor generates heat at the point of incident electromagnetic radiation;

wherein the heat generated at the point of incident electromagnetic radiation at the photoreceptor is applied to the print substrate;

wherein the heat generated by the photoreceptor causes dampening fluid patterning on the print substrate;

wherein the dampening fluid patterning forms a latent image on the print substrate.

2. The apparatus of claim 1, further comprising:

an inking system for applying ink to the print substrate having patterned dampening fluid disposed thereon.

3. The apparatus of claim 2, wherein the photoreceptor is a drum or a plate.

4. The apparatus of claim 3, wherein the print substrate is transparent to the incident electromagnetic radiation.

5. The apparatus of claim 4, wherein dampening fluid patterning is removing, at the print substrate, a portion of the dampening solution through evaporation.

6. The apparatus of claim 5, further comprising:

developing the latent image by application of ink or other material that only adheres to evaporated areas on the print substrate.

7. The apparatus of claim 2, wherein the photoreceptor and the print substrate are combined to create a print substrate that generates heat from the incident electromagnetic radiation for dampening fluid patterning on the print substrate.

8. The apparatus of claim 2, wherein the print substrate comprises two layers where one layer is transparent to the incident electromagnetic radiation and the second layer is absorbent of the incident electromagnetic radiation.

9. The apparatus of claim 2, wherein the print substrate comprises three layers and wherein a layer that is absorbent of the incident electromagnetic radiation is sealed with a nonconductive transparent film.

10. A method for printing directly onto a print substrate in a variable data lithography system, comprising:

applying dampening fluid in an airborne state or by direct contact on said print substrate from a dampening fluid reservoir;

using a photoreceptor having a first surface that generates heat at the point of incident electromagnetic radiation;

applying electromagnetic radiation to the dampening fluid, the print substrate, and the photoreceptor;

applying the heat generated at the point of incident electromagnetic radiation at the photoreceptor to the print substrate;

wherein the heat generated by the photoreceptor causes dampening fluid patterning on the print substrate.

11. The method of claim 10, further comprising:

applying ink to the print substrate having patterned dampening fluid disposed thereon.

12. The method of claim 11, wherein the photoreceptor is a drum or a plate.

13. The method of claim 12, wherein the print substrate is transparent to the incident electromagnetic radiation.

14. The method of claim 13, wherein dampening fluid patterning is removing, at the print substrate, a portion of the dampening solution through evaporation.

15. The method of claim 14, wherein the dampening fluid patterning forms a latent image on the print substrate and the latent image is then developed by an application of ink or other material that only adheres to evaporated areas on the print substrate.

16. The method of claim 11, wherein the photoreceptor and the print substrate are combined to create a print substrate that generates heat from the incident electromagnetic radiation for dampening fluid patterning on the print substrate.

17. The method of claim 11, wherein the print substrate comprises two layers where one layer is transparent to the incident electromagnetic radiation and the second layer is absorbent of the incident electromagnetic radiation.

18. The method of claim 11, wherein the print substrate comprises three layers and wherein a layer that is absorbent of the incident electromagnetic radiation is sealed with a nonconductive transparent film.

19. A system useful in printing, comprising:

a print substrate comprising Infra-Red (IR) transparent material for carrying high viscosity inks and/or dampening fluid;

a dampening fluid reservoir configured to provide the dampening fluid to said print substrate;

a photoreceptor having a first surface which receives IR energy, wherein said photoreceptor generates heat at the point of incident of the IR energy and wherein the heat generated by the photoreceptor causes dampening fluid patterning on the print substrate;

an inking unit for applying a high viscosity ink to the print substrate having patterned dampening fluid disposed thereon;

a processor; and a storage device coupled to the processor, wherein the storage device contains instructions operative on the processor for:

causing an IR source to apply the IR energy to the print substrate and the photoreceptor to form a first process direction image on the print substrate;

applying the heat generated at the point of incident electromagnetic radiation at the photoreceptor to the print substrate;

applying the high viscosity ink on the print substrate; and repeating application of the IR energy and high viscosity ink on areas of the print substrate with remaining dampening fluid to form one or more additional image when it is determined that an additional image can be patterned on the print substrate.

20. The system of claim 19, wherein the photoreceptor is a drum or a plate.

21. The system of claim 20, wherein the print substrate is transparent to the IR energy.

22. The system of claim 21, wherein dampening fluid patterning is removing, at the print substrate, a portion of the dampening solution through evaporation.

23. The system of claim 22, wherein the dampening fluid patterning forms a latent image on the print substrate and the latent image is then developed by an application of ink or other material that only adheres to evaporated areas on the print substrate.

24. The system of claim 20, wherein the photoreceptor is the print substrate itself.

25. The system of claim 20, wherein the print substrate comprises two layers where one layer is transparent to the IR energy and the second layer is absorbent of the IR energy.

26. The system of claim 20, wherein the print substrate comprises three layers and wherein a layer that is absorbent of the IR energy is sealed with a nonconductive transparent film.

* * * * *